US005932385A

United States Patent [19]

Takamura et al.

[11] Patent Number: 5,932,385

[45] Date of Patent: Aug. 3, 1999

[54] ELECTROPHOTOGRAPHIC COPYING METHOD AND ELECTROPHOTOGRAPHIC COPYING MACHINE USED IN THE METHOD

[75] Inventors: Hiroaki Takamura, Odawara; Takahiro Choda; Itaru Ogawa, both of Yokohama; Mamoru Nozomi, Odawara, all of Japan

[73] Assignee: Mitsubishi Chemical Corporation, Tokyo, Japan

[21] Appl. No.: 08/956,393

[22] Filed: Oct. 23, 1997

[30] Foreign Application Priority Data

Oct. 23, 1996 [JP] Japan ..... 8-280729

[51] Int. Cl.[6] ..... G03G 5/14

[52] U.S. Cl. ..... 430/63; 399/153

[58] Field of Search ..... 430/58, 63, 65, 430/126; 399/153

[56] References Cited

U.S. PATENT DOCUMENTS

| | | | |
|---|---|---|---|
| 5,320,922 | 6/1994 | Mayama et al. | 430/63 |
| 5,612,158 | 3/1997 | Iguchi et al. | 430/65 |
| 5,614,343 | 3/1997 | Nozomi et al. | 430/100 |
| 5,688,621 | 11/1997 | Takegawa et al. | 430/64 |

FOREIGN PATENT DOCUMENTS

| | | |
|---|---|---|
| 0 510 538 | 10/1992 | European Pat. Off. . |
| 0 576 957 | 1/1994 | European Pat. Off. . |
| 0 718 699 | 6/1996 | European Pat. Off. . |

OTHER PUBLICATIONS

Database WPI Section Ch. Week 9528 Derwent Publications Ltd., London, GB; Class G06, AN 95–209846 XP002052738 & JP 07 120 953 A (Fuji Xerox), May 12, 1995.

Patent Abstracts of Japan 09222743, Aug. 26, 1997.

Patent Abstracts of Japan 09127711, May 16, 1997.

Patent Abstracts of Japan 08328284, Dec. 13, 1996.

*Primary Examiner*—John Goodrow

*Attorney, Agent, or Firm*—Oblon, Spivak, McClelland, Maier & Neustadt, P.C.

[57] ABSTRACT

An electrophotographic copying method, which comprises conducting each process of at least charging, exposing to light, developing and transferring, characterized in that the photoreceptor has at least an undercoat layer and a photosensitive layer on an electroconductive substrate, wherein the undercoat layer contains a semiconductive material having a band gap of at least 2.2 eV and a binder resin, the photosensitive layer contains at least a phthalocyanine compound as a charge-generation material, and image-formation is carried out from the first revolution of the photoreceptor.

13 Claims, No Drawings

ELECTROPHOTOGRAPHIC COPYING METHOD AND ELECTROPHOTOGRAPHIC COPYING MACHINE USED IN THE METHOD

The present invention relates to an electrophotographic copying method using a multilayer configuration type electrophotographic photoreceptor containing a specific compound, and an electrophotographic copying machine used in the method.

Since the electrophotographic technique invented by C. F. Carson provides instantly an image having a high quality and a satisfactory shelf stability, it is recently used not only in the field of copying machines but also in the fields of various printers and facsimiles, and its use is further extended widely.

This electrophotographic process comprises an image-forming process basically comprising uniformly charging the surface of a photoreceptor, forming an electrostatic latent image corresponding to an original copy by exposure to light, developing the latent image with a toner, transferring the toner image to a paper (sometimes by way of an intermediate transferring material) and fixing, and an initiated process for repeated use of the photoreceptor, i.e. cleaning for removing the developer remaining on the photoreceptor surface and an erasing process for removing the residual charge.

With regard to a photoreceptor which is an essential material for the electrophotographic technique, there has been conventionally used an inorganic photoconductive material such as selenium, arsenic-selenium alloy, cadmium sulfide or zinc oxide as a photoconductive material, and there has been recently developed a photoreceptor using an organic photoconductive material having an advantage that is easily film-formable and easily producible without causing an environmental pollution.

Among them, a multilayer configuration type photoreceptor having a charge-generation layer and a charge-transport layer laminated, is now produced as the main product of photoreceptors on a large scale, due to advantages that a photoreceptor having a high sensitivity can be obtained, that starting materials can be selected from a wide range and a photoreceptor having a satisfactory safety can be obtained, and that coating can be made in a high productivity at a relatively low cost.

Recently, in order to obtain an image of high quality, to memorize an input image or to freely edit, digitization for image-formation is rapidly progressed. Up to now, digital image-formation has been limited to a laser printer, a LED printer or a sort of color laser copier, which is an output device of a word processor, a personal computer or the like, but the digital image-formation is now applied to the field of an ordinary copying machine which employs mainly analogous image formation heretofore.

In such digital image-formation, when using computer information directly, the information is inputted into a photoreceptor by converting its electric signal into a light signal, and when taking information from an original copy, the information is inputted into a photoreceptor by reading the information from the original copy as light information, converting the light information into a digital electric signal and converting the electric signal into light information again. In any case, the information is inputted into the photoreceptor as a light signal, and in the light input of the digital signal, laser light or LED light is mainly used. At present, the most popularly used transmitting wavelength of the input light is a near infrared light of 780 nm or 660 nm or a long wavelength light in the vicinity thereof. The first requirement with regard to a photoreceptor used in the digital image-formation is to have a sensitivity to these long wavelength lights, and various materials have been studied up to now. Among them, since a phthalocyanine compound can be relatively easily synthesized, and has a satisfactory sensitivity to a long wavelength light, it has been widely studied and practically used.

For example, JP-B-5-5860 discloses a photoreceptor using titanylphthalocyanine; JP-A-59-155851 discloses a photoreceptor using β-type indium phthalocyanine; JP-A-2-233769 discloses a photoreceptor using x-type metal-free phthalocyanine; and JP-A-61-28557 discloses a photoreceptor using vanadyloxy phthalocyanine.

However, photoreceptors using these phthalocyanine compounds as charge-generation materials had high sensitivities to long wavelength lights, but had a disadvantage that the charged potential was low at the first revolution of a copying machine and became stable only after the second revolution.

A multilayer configuration type photoreceptor using a phthalocyanine compound in a charge-generation layer is widely practically used, but this phenomenon occurs in any of such photoreceptors to some degree.

This phenomenon is a problem inherent in the multilayer configuration type photoreceptor using a phthalocyanine compound since this phenomenon does not occur in a multilayer configuration type photoreceptor using an azo pigment in a charge-generation layer (an azo pigment has a problem that its sensitivity to a long wavelength light is low).

This phenomenon is related to a standing time after the image-formation process including charging and light exposure, and the charged potential at the first revolution tends to become lower if the standing time becomes longer, for example, 30 minutes, one hour or longer. Thus, it is considered that this phenomenon is related to an occurrence of a dark charge by a phthalocyanine compound during allowing to stand and its accumulation in a charge-generation layer, or to accumulation of a charge flown from a conductive substrate and an undercoat layer into a charge-generation layer.

It has been known that the surface potential is largely lowered in the first revolution process when a photoreceptor is substantially fatigued by repeated use. It is considered that this is because an electron trap amount in a charge-generation layer is gradually increased by the fatigue as compared with the initial stage.

On the other hand, in the case of digital image-formation, in order to efficiently use light or to improve a resolution, the so-called reversal development system where a toner is attached to a light-irradiated part, is often used. In the reversal development process, an unexposed part (dark potential part) becomes a white part, and an exposed part (light potential part) becomes a black part (image part).

Thus, in the reverse development process, even when a light part potential is elevated, such a fogged image (a phenomenon of causing a black spot on a white part) as in normal development process does not occur, but a fogging image occurs when a dark potential is lowered. Therefore, a photoreceptor using a phthalocyanine compound has a high sensitivity, but does not provide a satisfactory image in the first revolution process since a background is severely soiled. Further, when copying is carried out continuously, a substantially satisfactory image can be obtained in the second revolution process of the photoreceptor although a background is still somewhat soiled, and satisfactory images can be obtained thereafter.

As mentioned above, when a multilayer configuration type photoreceptor using a phthalocyanine compound in a charge-generation layer is used in an electrophotographic process for reverse development including a photo-erasing process, the above problem may be caused. Thus, heretofore, the above problem has been avoided by not conducting image formation at the first revolution at which a charged potential is lowered (i.e. idle revolution) and by conducting image formation from the second revolution of the photoreceptor at which a surface potential becomes stable. Any inconvenience has not been caused even in the process of making idle revolution at the first revolution in the case of a reverse development system printer providing a relatively low copying speed (e.g. at most 10 sheets (A4)/min) since a charge-controlling function of a charger can work and data-transferring from computers and the like takes a considerable time. However, it is strongly demanded to conduct image formation from the first revolution of a photoreceptor when immediately copying an original copy, for example, by a digital copier providing a high copying speed, since the idle revolution becomes an obstacle to high speed copying.

The present inventors have studied an electrophotographic photoreceptor satisfactorily chargeable from the first revolution to a predetermined surface potential, which enables image-formation from the first revolution of the photoreceptor without conducting any idle revolution. As the result of the study, it has been discovered that a satisfactory image can be continuously obtained without conducting an idle revolution at the first revolution by charging a photoreceptor at the first revolution to a predetermined surface potential, which has a multilayer configuration comprising at least an undercoat layer containing at least a semiconductive material having a band gap of at least 2.2 eV and a binder resin on an electroconductive substrate, a charge-generation layer containing a phthalocyanine compound on the undercoat layer and a charge-transport layer thereon. The term "semiconductive material" used herein means generally any of charge-transpotable materials in the undercoat layer.

Thus, the essential feature of the present invention resides in an electrophotographic copying method, which comprises conducting each process of at least charging, exposing to light, developing and transferring, characterized in that the photoreceptor has at least an undercoat layer and a photosensitive layer on an electroconductive substrate, wherein the undercoat layer contains a semiconductive material and a binder resin, the photosensitive layer contains at least a phthalocyanine compound as a charge-generation material, and image-formation is carried out from the first revolution of the photoreceptor. (In the present invention, with regard to a material which does not form a band, a band gap value is an energy difference between HOMO and LUMO energies.)

The semiconductive material preferably has a conduction band edge position at −3.8 eV or lower from the vacuum level, examples of which include metal oxides such as titanium oxide. (In the present invention, with regard to a material which does not form a band, the conduction band edge is a LUMO position.)

Hereinafter, the present invention is further described in more details.

In the present invention, a multilayer configuration type photoreceptor is provided on an electroconductive substrate. Examples of the electroconductive substrate include metallic materials such as aluminum, aluminum alloy, stainless steel, copper, nickel and the like, aluminium-vapor deposited polyester films, papers, and the like. These materials, the surfaces of which are oxidation-treated, may be used.

An undercoat layer comprises at least a binder resin and a semiconductive material having a band gap of at least 2.2 eV. Examples of the semiconductive material include titanium oxide, aluminum oxide, a titanate such as calcium titanate, strontium titanate and barium titanate, a metal oxide such as silicon oxide zirconium oxide, zinc oxide, tungsten oxide, bismuth oxide and iron oxide, a metal nitride such as aluminum nitride, a metal carbide particle such as silicon carbide and titanium carbide, a sulfide such as molybdenum sulfide, a sulfate such as barium sulfate, a hydrazone type semiconductive agent and an electron-transport agent such as MBDQ(3,5-dimethyl-3',5'-di-tert-butyl-4,4'-diphenoquinone). Among them, a semiconductive material having a conduction band edge position of −3.8 eV or lower from the vacuum level is used. Preferable examples of such a semiconductive material include titanium oxide, strontium titanate, calcium titanium, tungsten oxide, iron oxide, bismuth oxide, molybdenum sulfide and the like, but titanium oxide is most preferable in view of cost and dispersibility.

It is not clear the reason why a semiconductive material having a band gap of at least 2.2 eV is preferable, but it is considered that in the case of an undercoat layer containing a semiconductive material having a band gap of less than 2.2 eV, a charge (hole) from an electroconductive substrate is liable to be transferred to and accumulated in a charge-generation layer or that the semiconductive material is liable to cause a dark charge and the charge is liable to be transferred to and accumulated in the charge-generation layer.

Further, it is not clear the reason why a semiconductive material having a conduction band edge of −3.8 eV or lower from the vacuum level is preferable, but it is considered that transferring of an electron from an electron trap occurred in a charge-generation layer can be smoothly conducted in the presence of the above semiconductive material. If the semiconductive material has a conduction band edge of −3.8 eV or higher from the vacuum level, an electron is not smoothly transferred and a charged potential at the first revolution process tends to become low.

Further, in the case of anodized aluminum generally used as an undercoat layer, it is considered that since a residual potential in an electrophotographic process is low, an electron (present in the vicinity of the conduction band edge of phthalocyanine) generated in this process can be smoothly transferred. However, the surface potential at the first cycle after allowing to stand at the fatigued state is low. This means that an electron is not smoothly transferred since an electron trap level produced in a charge-generation layer is considerably deeper due to the fatigue as compared with an electron level produced by a usual electrophotographic process. Therefore, it is necessary for making a charged potential at the first revolution higher to use a semiconductive material having a lower (deeper) conduction band edge than alumite, so as to smoothly transfer an electron from the electron trap level.

When a dispersion particle is a metal oxide such as titanium oxide, its surface may be treated with an inorganic material such as tin oxide, aluminum oxide, antimony oxide, zirconium oxide and silicon oxide or an organic material such as stearic acid, polyol and silicone, but it is preferable that its surface is not treated or coated with a metal atom-containing organic compound. Examples of the metal atom-containing organic compound include generally a silane coupling agent or polysiloxanes substituted with an organic group. Among them, methyl hydrogen polysiloxane is most preferable since it provides a satisfactory stability of a coating solution and improves a blocking property.

Any crystal form of titanium oxide such as rutile-, anatase- or brookite-form may be used, and an amorphous form may also be used. However, a rutile-form is general. Further, an average primary particle size is preferably from 10 nm to 100 nm, more preferably from 10 nm to 50 nm, in view of various properties and the stability of a coating solution.

Further, when a semiconductive material in an undercoat layer is a dispersion particle, the surface area of the dispersion particle is preferably at least 40 $m^2$ per 1 $cm^3$ volume of the undercoat layer. The surface area can be increased for example by increasing a dispersion particle content or by reducing a particle size of a dispersion particle. It is expected that since an effective contact rate between an electron trap produced in a charge-generation layer and a dispersion particle is increased, the trapped electron can be easily transferred to the undercoat layer (dispersion particle). For the same reason, when a semiconductive material in the undercoat layer is a molecule, the amount of the semiconductive molecule is preferably increased as far as it does not impair the solubility to a coating solution and the function (adhesiveness and blocking property) of the undercoat layer.

In the present invention, the structure of the undercoat layer is limited to such a structure as to contain a semiconductive material and a binder resin, but this is because an effective contact rate of an electron trap produced in a charge-generation layer is hardly increased when the undercoat layer is a vapor deposition film or an anodized film. Thus, when comprising a semiconductive material and a binder resin, an effective contact rate between the electron trap and the semiconductive material is liable to be increased when the binder resin of the undercoat layer has a satisfactory compatibility with a binder resin of a charge-generation layer. Further, even when the compatibility between the binder resins is low, the semiconductive material works as a bridge between the undercoat layer and the charge-generation layer, thereby increasing an effective contact rate.

Also, even when the undercoat layer comprises a binder resin alone or a semiconductive material alone, it is considered that the same effect as mentioned above can be achieved by using a resin having a semiconductive material grafted as a binder resin or by using a semiconductive particle film of sol-gel film.

Examples of the binder resin include polyvinylpyrrolidone, polyacrylic acid, methylcellulose, nitrocellulose, polyvinylacetal, gelatin, starch, phenoxy, epoxy, polyurethane, polyimide and polyamide resins, and they can be used respectively alone or in a cured form with a curing agent. Among them, binder resins such as alcohol-soluble copolymerized polyamide and modified polyamide are preferable in view of dispersibility and coating property. Among the polyamide resins, a copolymerized polyamide having a diamine component of the following formula (I) as a constituent is particularly preferable in view of various properties and liquid stability. This polyamide preferably has a number average molecular weight of from 5,000 to 300,000. Further, as mentioned above, a resin having a high compatibility with a binder resin in a charge-generation layer is preferable as far as it does not achieve an adverse effect on coating property and blocking property.

(I)

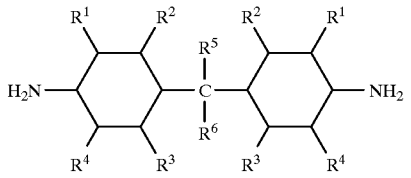

(Wherein $R^1$, $R^2$, $R^3$, $R^4$, $R^5$ and $R^6$ are independently a hydrogen atom, an alkyl group or an alkoxy group.)

An amount of a dispersion particle to be added to a binder resin can be optionally selected, but a preferable amount is in the range of from 10 wt % to 500 wt % to provide satisfactory preservation stability and coating property of a dispersion solution. Further, in order to improve a surface potential of the first revolution, it is preferable to make the amount of the dispersion particle so as to provide a surface area of at least 40 $m^2/cm^3$ of volume of undercoat layer.

If necessary, various additives can be added to an undercoat layer. Examples of the additives include carbon black, an organic silicate compound, an organic zirconium compound and the like, and further include a hindered amine type or phenol type antioxidant. Further, in order to improve a coating property, a silicone oil or a fluorine type surfactant may be added.

An undercoat layer has a film thickness of from 0.05 $\mu$m to 10 $\mu$m, preferably from 0.2 $\mu$m to 5 $\mu$m.

As a charge-generation material in a charge-generation layer, a phthalocyanine compound is used. Examples of the phthalocyanine compound used, include metal-free phthalocyanines or phthalocyanines having metals such as copper, indium, gallium, tin, titanium, zinc or vanadium or their oxides or chlorides coordinated. Particularly preferable examples include highly sensitive x-form or r-form metal-free phthalocyanine, A-form, B-form or D-form titanyl phthalocyanine, vanadyl phthalocyanine, chloroindium phthalocyanine and the like. Among various crystal forms of the above listed titanyl phthalocyanine, A-form and B-form are illustrated respectively as I phase and II phase by W. Hiller et al (Z. Kristallogr., 159 (1982)173), and A-form is known to be a stable form. D-form is a crystal form characterized by having a clear peak at a diffraction angle ($2\theta \pm 0.20$) of 27.3° in powder X-ray diffraction using CuK$\alpha$ ray.

In addition to phthalocyanine, a charge-generation material may be incorporated into a charge-generation layer in order to vary a spectral sensitivity and to improve electric properties such as charge acceptance and residual potential. Examples of such a charge-generation material include selenium and its alloy, arsenic-selenium, cadmium sulfide, zinc oxide, and other inorganic photoconductive materials, azo dye, quinacridone, polycyclic quinone, pyrylium salt, thiapyrylium salt, indigo, thioindigo, anthanthrone, pyranthrone, cyanine and the like.

A charge-generation layer may be a dispersion layer formed by binding fine particles (preferably having an average particle size of not larger than 1 $\mu$m, more preferably not larger than 0.5 $\mu$m, most preferably not larger than 0.3 $\mu$m) of these charge-generating materials with various binder resins such as polyester resin, polyvinyl acetate, polyacrylic acid ester, polymethacrylic acid ester, polyester, polycarbonate, polyvinyl acetoacetal, polyvinyl propional, polyvinyl butyral, phenoxy resin, epoxy resin, urethane resin, cellulose ester, cellulose ether and the like.

A charge-generating material is used in a weight ratio of from 30 to 500 parts by weight to 100 parts by weight of a binder. Its film thickness is generally from 0.1 to 2 μm, preferably from 0.15 to 0.8 μm. A charge-generation layer may contain various additives such as a leveling agent to improve a coating property, an antioxidant, a sensitizer and the like, if necessary. A charge-generation layer may be a vapor-deposition film of the above charge-generating material.

Examples of a semiconductive material used in a charge-transport layer include 2,4,7-trinitrofluorenone, tetracyanoquinodimethane, a heterocyclic compound such as carbazole, indole, imidazole, oxazole, pyrazole, oxadiazole, pyrazoline, thiadiazole or the like, an aniline derivative, a hydrazone compound, an aromatic amine derivative, a stilbene derivative, or a polymer having a group of these compounds on the main chain or a side chain, which is an electrodonative material. A charge-transport layer is formed by binding these semiconductive materials with a binder resin.

Examples of the binder resin used in the charge-transport layer include polymethylmethacrylate, polystyrene, a vinyl polymer such as polyvinyl chloride or the like, and its copolymer, polycarbonate, polyester, polyester carbonate, polysulfone, polyimide, phenoxy, epoxy, silicone resins and the like, or these partly crosslinked cured materials can also be used.

A semiconductive material is used in a ratio of usually from 30 to 200 parts by weight, preferably from 40 to 150 parts by weight, to 100 parts by weight of a binder resin. Its film thickness is generally from 5 to 50 μm, preferably from 10 to 45 μm. The charge-transport layer may further contain well-known additives such as a plasticizer, an antioxidant, a UV ray absorber, a leveling agent and the like in order to improve a film-formability, a flexibility, a coating property or the like.

These undercoat layers and photosensitive layers are formed on an electroconductive substrate by dip coating, spray coating, nozzle coating or other means.

The present electrophotographic method includes each process of charging, exposing to light, reversal development and transferring, and any of these processes may employ a usually used method. As a charging method, there may be employed any one of corotron or scorotron charging using corona discharge and contact charging using an electroconductive roller or a brush. As a charging method using corona discharge, scorotron charging is often used in order to maintain a dark potential constant. As a developing method, there is employed a general method using a magnetic or non-magnetic monocomponent-developer, two component-developer or the like with contact or without contact, but in any case, reversal development developing a light potential is employed. As a transferring method, there is employed any method using corona discharge, a transferring roller or the like. Generally, a fixing process for fixing a developer on a paper or the like is employed, and generally heat-fixing or press-fixing is used as the fixing process. In addition to these processes, cleaning process, erasing process or the like may be employed.

EXAMPLES

Now, the present invention will be described in further detail with reference to Examples and Comparative Examples. However, it should be understood that the present invention is by no means restricted to such specific Examples.

Charge acceptance at the first revolution of photoreceptors of Examples and Comparative Examples was evaluated by at least one method of the following three methods.

(A) Method: A photoreceptor (a drum having an outer diameter of 80 mm was used in this method only) was fixed on a device of measuring photoreceptor properties, and each process of charging (corotron: about −700 V), exposing to light and erasing was repeated for 1 hour at a revolution rate of 25 rpm. Thereafter, after allowing the photoreceptor to stand for 30 minutes, charging was conducted without exposing to light and a surface potential at the first revolution was measured.

(B) Method: A photoreceptor was adapted for reverse-development, and was fixed on a copying machine conducting copying process from the first revolution of the photoreceptor at a processing speed of 190 mm/sec. A device of measuring a surface potential of the photoreceptor was mounted on the copying machine, and each process of charging (scorotron: about −650 V), exposing to light and erasing was repeated for one hour. The copying machine was maintained with an electric power on so as not to conduct warming-up action (idle revolution of the photoreceptor before image-formation), and was allowed to stand for 30 minutes. Thereafter, copying process was conducted by pushing a copying button, and a surface potential of an unexposed part of the photoreceptor was measured.

(C) Method: A photoreceptor was adapted for reverse-development, and was fixed on a copying machine conducting copying process from the first revolution of the photoreceptor at a processing speed of 190 mm/sec. A device of measuring a surface potential of the photoreceptor was mounted on the copying machine, and each process of charging (scorotron: about −650 V), exposing to light and erasing was repeated to conduct 50,000 copying processes (corresponding to 50,000 A4 copy sheets by cross-feeding). The copying machine was maintained with an electric power on so as not to conduct warming-up action (idle revolution of the photoreceptor before image-formation), and was allowed to stand for 1 hour. Thereafter, copying process was conducted by pushing a copying button, and a surface potential of an unexposed part of the photoreceptor was measured.

EXAMPLE 1

(1) Preparation of undercoating solution 1

A mixed alcohol (methanol/n-propanol=7/3) solution having polyamide copolymer A of the following formula dissolved, was mixed with a mixed alcohol solution having titania (tradename TTO55N: rutile-form, average primary particle diameter=about 40 μm, manufactured by Ishihara Sangyo K.K.) (band gap=3.2 eV, conduction band edge position=−4.5 eV) dispersed by a ball mill, and the resultant mixture was subjected to dispersion treatment by ultrasonic wave to prepare an undercoating solution 1 having TTO55N/nylon=3/1 composition (weight ratio) at a solid content concentration of 16%. The titanium oxide had a surface area of 72 $m^2$ per 1 $cm^3$ volume of an undercoat layer.

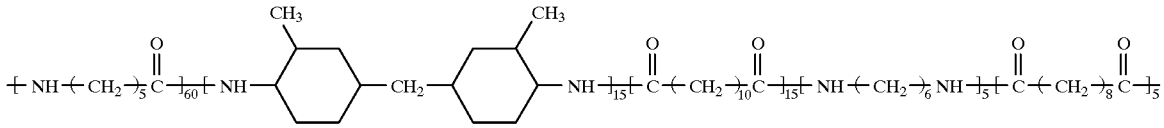

(2) Preparation of charge-generation (CG) coating solution 1

7 Parts by weight of D-form titanylphthalocyanine, 3 parts by weight of A-form titanylphthalocyanine and 5 parts by weight of polybutyral (tradename Eslec BH-3 manufactured by Sekisui Kagaku Kogyo K.K.) were dispersed in 100 parts by weight of 1,2-dimethoxyethane solution to obtain a CG coating solution 1.

(3) Preparation of charge-transport (CT) coating solution 1

70 Parts by weight of hydrazone compound of the following formula,

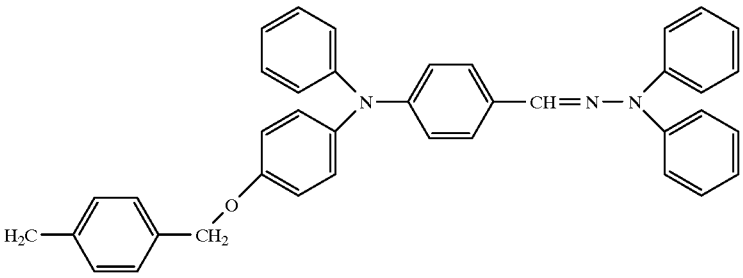

and 100 parts by weight of polycarbonate resin (Novarex 7030A manufactured by Mitsubishi Chemical Corporation) were dissolved in 1,000 parts by weight of 1,4-dioxane to obtain a CT coating solution 1.

(4) Preparation of photoreceptor

The above prepared undercoating solution 1 was coated on an aluminum-vapor-deposited polyester film (about 75 μm thickness) by a wire bar so as to provide an undercoat layer (UCL) having a dry film thickness of 0.75 μm, and the above prepared CG coating solution 1 was coated thereon by a wire bar so as to provide a charge-generation layer having a dry film thickness of 0.5 μm, and the above prepared CT coating solution 1 was further coated thereon by an applicator so as to provide a charge-transport layer having a dry film thickness of 25 μm. The photoreceptor film thus obtained was mounted on an aluminum cylinder having an outer diameter of 65 mm and a length of 348 mm, thus providing a photoreceptor A.

(5) Evaluation of photoreceptor

The photoreceptor A thus obtained was evaluated by C method, and the evaluation results are shown in the following Table 1.

EXAMPLE 2

A photoreceptor was prepared in the same manner as in Example 1, except that an undercoating solution was prepared in the following manner, and the photoreceptor was evaluated in the same manner as in Example 1. The evaluation results of the photoreceptor are shown in the following Table 1.

(1) Preparation of undercoating solution 2

A mixed alcohol (methanol/n-propanol=7/3) solution having polyamide copolymer A dissolved, was mixed with a mixed alcohol solution having titania (TTO55N) dispersed by a ball mill, and the resultant mixture was subjected to dispersion treatment by ultrasonic wave to obtain an undercoating solution 2 having TTO55N/nylon=2/1 composition (weight ratio) at a solid content concentration of 13.5%. The titanium oxide had a surface area of 56 $m^2$ per 1 $cm^3$ volume of an undercoat layer.

EXAMPLE 3

A photoreceptor was prepared in the same manner as in Example 1, except that an undercoating solution was prepared in the following manner, and the photoreceptor thus obtained was evaluated in the same manner as in Example 1. The evaluation results of the photoreceptor are shown in the following Table 1.

(1) Preparation of undercoating solution 3

A mixed alcohol (methanol/n-propanol=7/3) solution having polyamide copolymer A dissolved, was mixed with a mixed alcohol solution having titania (TTO55N) dispersed by a ball mill, and the resultant mixture was subjected to dispersion treatment by ultrasonic wave to obtain an undercoating solution 3 having TTO55N/nylon=1.5/1 composition (weight ratio) at a solid content concentration of 11.25%. The titanium oxide had a surface area of 46 $m^2$ per 1 $cm^3$ volume of an undercoat layer.

EXAMPLE 4

A photoreceptor was prepared in the same manner as in Example 1, except that an undercoating solution was prepared in the following manner, and the photoreceptor thus obtained was evaluated in the same manner as in Example 1. The evaluation results of the photoreceptor are shown in the following Table 1.

(1) Preparation of undercoating solution 4

A mixed alcohol (methanol/n-propanol=7/3) solution having polyamide copolymer A dissolved, was mixed with a mixed alcohol solution having titania (TTO55N) dispersed by a ball mill, and the resultant mixture was subjected to dispersion treatment by ultrasonic wave to obtain an undercoating solution 4 having TTO55N/nylon=1/1 composition (weight ratio) at a solid content concentration of 9%. The titanium oxide had a surface area of 34 $m^2$ per 1 $cm^3$ volume of an undercoat layer.

EXAMPLE 5

A photoreceptor was prepared in the same manner as in Example 1, except that an undercoating solution was prepared in the following manner, and the photoreceptor thus obtained was evaluated in the same manner as in Example 1. The evaluation results of the photoreceptor are shown in the following Table 1.

(1) Preparation of undercoating solution 5

A mixed alcohol (methanol/n-propanol=7/3) solution having polyamide copolymer A dissolved, was mixed with a mixed alcohol solution having titania (tradename MT-150W rutile-form, average primary particle size=17 nm, manufactured by Teika K.K.) dispersed by a ball mill, and the resultant mixture was subjected to dispersion treatment by ultrasonic wave to obtain an undercoating solution 5 having titania/nylon=1/1 composition (weight ratio) at a solid content concentration of 9%. The titanium oxide had a surface area of 80 $m^2$ per 1 $cm^3$ volume of an undercoat layer.

EXAMPLE 6

A photoreceptor was prepared in the same manner as in Example 1, except that an undercoating solution was prepared in the following manner, and the photoreceptor thus obtained was evaluated in the same manner as in Example 1. The evaluation results of the photoreceptor are shown in the following Table 1.

(1) Preparation of undercoating solution 6

A mixed alcohol (methanol/n-propanol=7/3) solution having polyamide copolymer A dissolved, was mixed with a mixed alcohol solution having titania (tradename IT-OD amorphous-form treated with silicone, average primary particle size=17 nm, manufactured by Idemitsu Kosan K.K.) dispersed by a ball mill, and the resultant mixture was subjected to dispersion treatment by ultrasonic wave to obtain an undercoating solution 6 having titania/nylon=1/1 composition (weight ratio) at a solid content concentration of 9%.

The titanium oxide had a surface area of 63 $m^2$ per 1 $cm^3$ volume of an undercoat layer.

EXAMPLE 7

A photoreceptor was prepared in the same manner as in Example 1, except that an undercoating solution was prepared in the following manner, and the photoreceptor thus obtained was evaluated in the same manner as in Example 1. The evaluation results of the photoreceptor are shown in the following Table 1.

(1) Preparation of undercoating solution 7

A mixed alcohol (methanol/n-propanol=7/3) solution having polyamide copolymer A dissolved, was mixed with a mixed alcohol solution having titania (TTO55N titania having a surface treated with 3 wt % trimethylolethane) dispersed by a ball mill, and the resultant mixture was subjected to dispersion treatment by ultrasonic wave to obtain an undercoating solution 7 having titania/nylon=1.5/1 composition (weight ratio) at a solid content concentration of 11.25%.

The titanium oxide had a surface area of 46 $m^2$ per 1 $cm^3$ volume of an undercoat layer.

EXAMPLE 8

A photoreceptor was prepared in the same manner as in Example 1, except that an undercoating solution was prepared in the following manner and an undercoat layer having a film thickness of 1 $\mu$m was formed. The photoreceptor thus obtained was evaluated by A method, B method and C method. The evaluation results are shown in the following Table 1.

(1) Preparation of undercoating solution 8

A mixed alcohol (methanol/n-propanol=7/3) solution having polyamide copolymer A dissolved, was mixed with a mixed alcohol solution having alumina (tradename Aluminium Oxide C: average primary particle size=about 13 nm, manufactured by Nippon Aerosil K.K.) (band gap=9.0 eV, conduction band edge position=−1.8 eV) dispersed by ultrasonic wave, and the resultant mixture was subjected to dispersion treatment by ultrasonic wave to obtain an undercoating solution 8 having alumina/nylon=1/1 composition (weight ratio) at a solid content concentration of 8%.

The alumina oxide had a conduction band edge at the position of about 3 eV from the vacuum level, and had a surface area of 79 $m^2$ per 1 $cm^3$ volume of an undercoat layer.

EXAMPLE 9

A photoreceptor was prepared in the same manner as in Example 1, except that an undercoating solution was prepared in the following manner and an undercoat layer having a film thickness of 0.5 $\mu$m was formed. The photoreceptor thus obtained was evaluated by A method, B method and C method. The evaluation results are shown in the following Table 1.

(1) Preparation of undercoating solution 9

A mixed alcohol (methanol/n-propanol 7/3) solution having polyamide copolymer A dissolved, was mixed with a mixed alcohol solution having alumina (tradename UA-5305, average primary particle size=100 nm, manufactured by Showa Denko K.K.) dispersed by a ball mill, and the resultant mixture was subjected to dispersion treatment by ultrasonic wave to obtain an undercoating solution 9 having alumina/nylon=2/1 composition (weight ratio) at a solid content concentration of 12%.

The alumina had a surface area of 32 $m^2$ per 1 $cm^3$ volume of an undercoat layer.

EXAMPLE 10

A photoreceptor was prepared in the same manner as in Example 1, except that an undercoating solution was prepared in the following manner and an undercoat layer having a film thickness of 0.75 $\mu$m was formed. The photoreceptor thus obtained was evaluated by A method, B method and C method. The evaluation results of the photoreceptor are shown in the following Table 1.

(1) Preparation of undercoating solution 10

A mixed alcohol (methanol/n-propanol=7/3) solution having polyamide copolymer A dissolved, was mixed with a mixed alcohol solution having titania (TTO55N titania having a surface treated with 3 wt % methyl hydrogen polysiloxane) dispersed by a ball mill, and the resultant mixture was subjected to dispersion treatment by ultrasonic wave to obtain an undercoating solution 10 having titania/nylon=3/1 composition (weight ratio) at a solid content concentration of 16%.

COMPARATIVE EXAMPLE 1

A comparative photoreceptor was prepared in the same manner as in Example 1, except that an undercoat layer was not provided. The comparative photoreceptor thus obtained was evaluated by A method and B method. The evaluation results are shown in the following Table 1.

COMPARATIVE EXAMPLE 2

A comparative photoreceptor was prepared in the same manner as in Example 1, except that an undercoating solution was prepared in the following manner and an undercoat layer having a film thickness of 1 μm was formed. The comparative photoreceptor thus obtained was evaluated by A method. The evaluation results are shown in the following Table 1.

(1) Preparation of undercoating solution 11

6/66/610 Polyamide copolymer (tradename: T-171) manufactured by Daicelhules Co. was dissolved in a mixed alcohol (methanol/n-propanol=7/3) solution to obtain an undercoating solution 11 having a solid content concentration of 5%.

COMPARATIVE EXAMPLE 3

An aluminum substrate having an anodized aluminum-treated surface (outer diameter 65 mm, length 348 mm) was dipped in the above prepared CG coating solution 1, and was taken up to form a charge-generation layer having a dry film thickness of 0.5 μm. The cylinder thus obtained was further dip-coated with the above prepared CT coating solution 1 to form a charge-transport layer having a dry film thickness of 25 μm. The photoreceptor thus prepared was evaluated by B method. The evaluation results are shown in the following Table 1.

COMPARATIVE EXAMPLE 4

A comparative photoreceptor was prepared in the same manner as in Example 1, except that an undercoating solution was prepared in the following manner and an undercoat layer having a film thickness of 0.4 μm was formed. The comparative photoreceptor thus obtained was evaluated by A method and C method. The evaluation results are shown in the following Table 1.

(1) Preparation of undercoating solution 12

10 Parts by weight of an azo compound of the following formula was added to 150 parts by weight of 1,2-dimethoxyethane, and the resultant mixture was ground and dispersed by a sand grind mill.

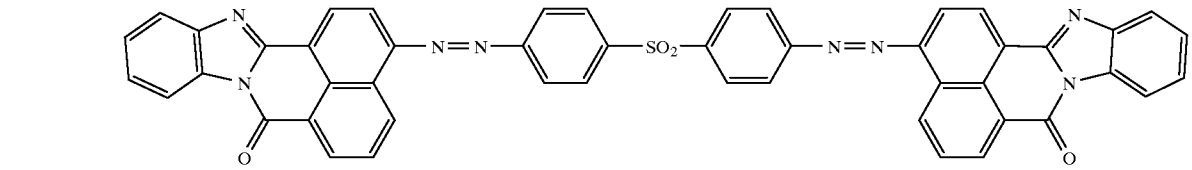

(band gap=1.7 eV, conduction band edge position=−3.3 eV)

A binder solution was prepared by mixing 100 parts by weight of 4% 1,2-dimethoxyethane solution of polyvinylbutyral (tradename Eslec BH-3 manufactured by Sekisui Kagaku K.K.) with 100 parts by weight of 4% 1,2-dimethoxyethane solution of phenoxy resin (tradename PKHH manufactured by Union Carbide Co.).

160 Parts by weight of the above prepared pigment dispersion solution was mixed with 200 parts by weight of the binder solution thus obtained and 90 parts by weight of 4,2-dimethoxyethane to finally obtain a dispersion solution having a solid content concentration of 4.0%.

COMPARATIVE EXAMPLE 5

A comparative photoreceptor was prepared in the same manner as in Example 1, except that an undercoating solution was prepared in the following manner and an undercoat layer having a film thickness of 0.4 μm was formed. The comparative photoreceptor thus obtained was evaluated by A method and C method. The evaluation results are shown in the following Table 1.

(1) Preparation of undercoating solution 13

10 Parts by weight of an azo compound of the following formula was added to 150 parts by weight of 1,2-dimethoxyethane, and the resultant mixture was ground and dispersed by a sand grind mill.

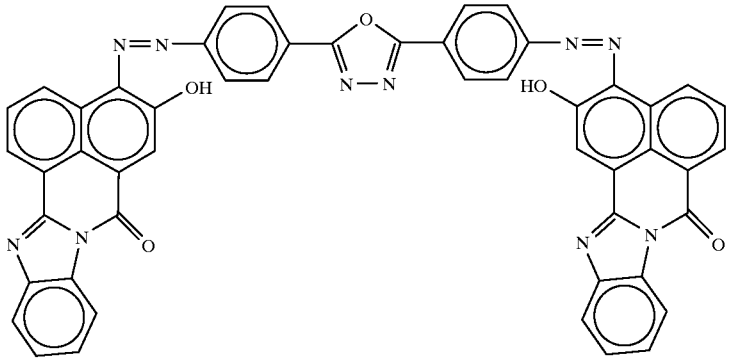

(band gap=1.75 eV, conduction band edge position=−3.25 eV)

A binder solution was prepared by mixing 100 parts by weight of 4% 1,2-dimethoxyethane solution of polyvinylbutyral (tradename Eslec BH-3 manufactured by Sekisui Kagaku K.K.) with 100 parts by weight of 4% 1,2-dimethoxyethane solution of phenoxy resin (tradename PKHH manufactured by Union Carbide Co.).

160 Parts by weight of the above prepared pigment dispersion solution was mixed with 200 parts by weight of the binder solution thus obtained and 90 parts by weight of 1,2-dimethoxyethane to finally obtain a dispersion solution having a solid content concentration of 4.0%.

All the photoreceptors evaluated by A method were prepared by using an aluminum substrate having an outer diameter of 80 mm as a substrate.

TABLE 1

Difference in charged potentials at the first revolution and the forth revolution of unexposed part

| | UCL | A method (V) | B Method (V) | C method (V) |
|---|---|---|---|---|
| Example 1 | A titania 3/1 | | | 40 |
| Example 2 | A titania 2/1 | | | 70 |
| Example 3 | A titania 1.5/1 | | | 80 |
| Example 4 | A titania 1/1 | | | 135 |
| Example 5 | B titania 1/1 | | | 85 |
| Example 6 | C titania 1/1 | | | 115 |
| Example 7 | D titania 1.5/1 | | | 125 |
| Example 8 | E titania 3/1 | | | 90 |
| Example 9 | Alumina 1 | 60 | 45 | 125 |
| Example 10 | Alumina 2 | 60 | 60 | 135 |
| Comparative Example 1 | None | 160 | 115 | 195 |
| Comparative Example 2 | Nylon | 150 | | |
| Comparative Example 3 | Alumite | | 105 | |
| Comparative Example 4 | Azo 1 | 65 | | 150 |
| Comparative Example 5 | Azo 2 | 75 | | 150 |

As evident from the data in Table 1, in the Comparative Examples of (i) having no undercoat layer, (ii) using anodized image only as an undercoat layer, (iii) using a binder only as an undercoat layer and (iv) using a semiconductive material having a band gap of less than 2.2 eV and a binder resin, the differences in surface potential at the first revolution and the forth revolution of unexposed part were large. Therefore, these comparative photoreceptors caused fogged image on white ground image at the first revolution by reverse development, and could not be practically used. Thus, the comparative photoreceptors can not be used for a copying process in which image-formation is conducted from the first revolution.

On the other hand, the Examples of the present invention using an undercoat layer containing a semiconductive material having a band gap of at least 2.2 eV, provided photoreceptors in which a difference in charged potentials at the first revolution and the forth revolution of unexposed part was relatively small. Example 4 and Example 10 produced the largest difference (135 V) in surface potentials at the first revolution and the second revolution of unexposed part, but were still improved as compared with Comparative Examples 4 and 5 (difference in surface potentials at the first revolution and the second revolution of unexposed part=150 V), and were proved to be satisfactorily usable for a copying process wherein image-formation is conducted from the first revolution of a photoreceptor. Further, as evident from the data in Table 1, among the Examples, the most satisfactory Example had a semiconductive material having a conduction band edge position of −3.8 eV or lower from the vacuum level. Examples of such a semiconductive material include titanium oxide, strontium titanate, calcium titanate, tungsten oxide, iron oxide, bismuth oxide and molybdenum sulfide, and titanium oxide is most preferable among them. Further, when a semiconductive material is a particle, the surface of the particle is untreated or treated with a metal element-containing organic compound. Examples of the treating agent include a silane coupling agent and a siloxane compound. Among them, methyl hydrogen polysiloxane is most preferable as a treating agent since it can improve stability of a coating solution and a blocking property.

As mentioned above, the present invention provides a photoreceptor satisfactorily chargeable from the first revolution even when using a phthalocyanine compound as a charge-generation material, which is generally used for a laser printer, a LED printer and a digital copier due to a high sensitivity to a long wavelength light. By using the photoreceptor of the present invention, there can be provided an electrophotographic copying process wherein image-formation is conducted from the first revolution of the photoreceptor and an electrophotographic copying machine which can produce a satisfactory copy from the first revolution or which can produce copies at a high speed.

We claim:

1. An electrophotographic copying method, which comprises conducting each process of at least charging, exposing to light, developing and transferring, characterized in that the photoreceptor has at least an undercoat layer and a photosensitive layer on an electroconductive substrate, wherein the undercoat layer contains a semiconductive material having a band gap of at least 2.2 eV and a binder resin, the photosensitive layer contains at least a phthalocyanine compound as a charge-generation material, and image-formation is carried out from the first revolution of the photoreceptor.

2. The electrophotographic copying method according to claim 1, wherein the semiconductive material has a conduction band edge position of −3.8 eV or lower from the vacuum level.

3. The electrophotographic copying method according to claim 1, wherein the semiconductive material is dispersion particles having a surface area of at least 40 $m^2$ per 1 $cm^3$ volume of the undercoat layer.

4. The electrophotographic copying method according to claim 3, wherein the surface of the dispersion particles is uncoated or coated with a metal atom-containing organic compound.

5. The electrophotographic copying method according to claim 4, wherein the surface of the dispersion particles is coated with a silicon-containing compound.

6. The electrophotographic copying method according to claim 5, wherein the silicon-containing compound is methyl hydrogen polysiloxane.

7. The electrophotographic copying method according to claim 1, wherein the semiconductive material is titanium oxide.

8. An electrophotographic copying machine, which comprises conducting each process of at least charging, exposing to light, developing and transferring, characterized in that the photoreceptor has at least an undercoat layer and a photosensitive layer on an electroconductive substrate, wherein the undercoat layer contains at least a semiconductive material having a band gap of at least 2.2 eV and a binder resin, the photosensitive layer contains at least a phthalocyanine compound as a charge-generation material, and the copying machine does not have a function of idle revolution from the first revolution of the photoreceptor.

9. An electrophotographic copying method, which comprises conducting each process of at least charging, exposing to light, developing and transferring, characterized in that the photoreceptor has at least an undercoat layer and a photosensitive layer on an electroconductive substrate, wherein the undercoat layer contains a binder resin and at least one member selected from the group consisting of metal oxide particles, metal nitride particles, metal carbide particles, sulfate particles, and metal sulfide particles, the photosensitive layer contains at least a phthalocyanine compound as a charge-generation material, and image-formation is carried out from the first revolution of the photoreceptor.

10. The electrophotographic copying method according to claim 9, wherein the metal oxide particles are titanium oxide particles.

11. The electrophotographic copying method according to claim 9, wherein the metal oxide particles are aluminum oxide particles.

12. The electrophotographic copying method according to claim 9, wherein the binder resin is polyamide.

13. An electrophotographic copying machine, which comprises conducting each process of at least charging, exposing to light, developing and transferring, characterized in that the photoreceptor has at least an undercoat layer and a photosensitive layer on an electroconductive substrate, wherein the undercoat layer contains a binder resin and at least one member selected from the group consisting of metal oxide particles, metal nitride particles, metal carbide particles, sulfate particles, and metal sulfide particles, the photosensitive layer contains at least a phthalocyanine compound as a charge-generation material, and image-formation is carried out from the first revolution of the photoreceptor.

* * * * *